US005449076A

United States Patent [19]

Van Noord

[11] Patent Number: 5,449,076

[45] Date of Patent: Sep. 12, 1995

[54] FACING DEVICE

[76] Inventor: Andrew J. Van Noord, 1434 Hillsboro Ave. SE., Grand Rapids, Mich. 49506

[21] Appl. No.: 248,270

[22] Filed: May 24, 1994

[51] Int. Cl.[6] ..... A47F 5/00

[52] U.S. Cl. ..... 211/59.3; 211/51; 211/181

[58] Field of Search ..... 211/59.3, 51, 52, 53, 211/54.1, 181, 183; 312/61, 71

[56] References Cited

U.S. PATENT DOCUMENTS

| | | | |
|---|---|---|---|
| 2,175,059 | 10/1939 | Lower | 211/51 |
| 2,208,470 | 7/1940 | Olund | 211/51 X |
| 2,927,699 | 3/1960 | McGraw | 211/51 |
| 3,055,508 | 9/1962 | Keeser | 211/51 |
| 3,326,388 | 6/1967 | Zidek | 211/51 |
| 3,514,015 | 5/1970 | Hein | 211/51 X |

*Primary Examiner*—Robert W. Gibson, Jr.
*Attorney, Agent, or Firm*—Varnum, Riddering, Schmidt & Howlett

[57] ABSTRACT

A facing device is provided for facing products displayed in wire shelf racks having a forward end and a rear end, the rear end comprising a horizontal wire and a vertical wire. The facing device comprises a lever arm, a clip on the lever arm for rotatably mounting the lever arm to the horizontal wire in the shelf rack, and a coil spring between the lever arm and the shelf rack for biasing the lever arm forwardly. A retaining bracket is provided on the lever arm for holding the coil spring thereto, and a stop is provided on the bracket for limiting expansion of coil spring terminal ends.

13 Claims, 4 Drawing Sheets

FACING DEVICE

BACKGROUND OF THE INVENTION

1. Field of the Invention

The invention relates to devices for maintaining articles in spacial positions and, more particularly, to a spring loaded facing device for urging package commodities towards the front of a shelf.

2. Description of Related Art

In the retail sales industry, there is often a need to display a supply of products for selection and purchase by consumers. Various display cases, racks, hangers, open shelves, and the like have been used for this purpose. Many products, such as pre-recorded videotape cassettes, are stored in shelf-like wire racks affixed to walls or free-standing partitions and the like in retail outlets.

It is often desirable to store the products for sale on such racks in a particular orientation, such as with one product at the front of the shelf rack and identical products similarly oriented and stacked behind the front product. After a consumer has removed the product at the front of the shelf, it is desirable to "face" the remaining products, i.e., move the remaining products toward the front of the shelf. On horizontal shelves, particularly deep horizontal shelves, if the products are not moved towards the front or face of the shelf, the products will not be properly displayed to the customer in order to achieve desired merchandising and marketing effects, such as the prominent display of a famous or well-promoted label or brand name. It is also desirable to maintain the products to be sold in an organized fashion so as to present an orderly and attractive appearance to customers.

Automated devices for facing products on retail outlet shelves have been previously proposed. However, many such known devices are complicated and form an integral part of the shelving unit, making it difficult to retrofit the devices to existing shelving. For instance, the Robertson U.S. Pat. No. 4,899,893, issued Feb. 13, 1990, discloses a facing device including an elongated base element as part of the shelf. The base element has a fixed front stop and a sled mounted for slidable movement between the front and rear of the base element. An "article-engaging" panel projects upwardly from the sled to engage products placed on the base element. A spring urges the sled and thus the products toward the front stop. The spring has one end affixed to the front stop, extends along the base, and coils behind the panel. The tendency of the spring to return to its coiled shape biases the panel forwardly. Especially due to the sled mounting, the sliding mechanism is rather complicated and bulky, thereby taking up valuable space on the shelf which could be occupied by a product to be merchandised.

SUMMARY OF INVENTION

These and other disadvantages of the prior product facing devices are overcome by the present invention. In accordance with the invention, a facing device for facing products displayed in wire shelf racks is provided. The facing devices can be easily assembled to finished shelves, either as a part of new shelving or, alternatively, as a "retro-fit" to existing shelving. The shelf racks have a forward end and a rear end, with the rear end comprised of a horizontal wires and vertical wires.

The facing device includes a lever arm and a clip attached to the lever arm and adapted to be rotatably coupled to the horizontal wire. This provides for rotatable mounting of the lever arm to the shelf rack. In addition, a coil spring is provided, with the spring being coupled to the lever arm and adapted to be coupled to the shelf rack for biasing the lever arm to rotate about the horizontal wire toward the shelf rack forward end. The coil spring includes a coil of spring wire having first and second terminal ends extending tangentially from the coil. The first terminal end abuts the lever arm, and the second terminal end is adapted to be interconnected to the vertical wire upon assembly to the shelf.

The facing device also includes a retaining means for holding the coil spring in abutment with the lever arm. The retaining means includes a bracket on the lever arm which receives a coil of spring wire.

The coil spring also includes a catch on the second terminal end, with the catch being adapted to receive the vertical wire. The catch includes a portion of the second terminal end being folded over into a U-shaped configuration. The lever arm includes an elongated flat strip having an inner end and an outer end, with the clip being located at the inner end and a rounded surface being provided at the outer end to provide a smooth pushing surface against the products in the shelf rack.

The inner end of the lever arm is formed to fit partially around the horizontal wire. A spring clip is also formed to fit partially around the horizontal wire to provide a resilient means for rotatably mounting the facing device to the horizontal wire. The clip includes a semi-circular receiving surface for rotatably receiving the horizontal wire.

A stop on the lever arm is provided, which is positioned to abut the second terminal end of the spring at a predetermined limit of forward travel of the lever arm. This provides a limit to the spread of the first and second terminal ends from each other, so as to limits the spring-biased forward travel of the lever arm past the predetermined limit.

The retaining means holds the spring in abutment with the lever arm, and includes a bracket on the lever arm which receives the coil of spring wire. The stop is integral with the bracket. The bracket includes a forward wall, two side walls, and a stop extending inwardly from one side wall. The coil of spring is positioned therebetween.

An advantage of the relative structure and configurations of the lever arm, bracket and coil spring is the absence of any need for a specific pivot point for the coil spring. That is, with one end of the coil spring pressing against the underside of the lever arm, and with the specific structural configuration of the bracket and rear portion of the lever arm, the coil spring is maintained in position, while still providing appropriate forces to urge the lever arm against the rearmost videotape. Also, with attachment of the facing device to an existing shelf through the use of a resilient rotative securing means, the shelf components essentially become part of the "functional structure" of the facing device, at least with respect to "pivoting" and "stop" or "limiting" functions of the facing device.

BRIEF DESCRIPTION OF THE DRAWINGS

The invention will now be described with reference to the drawings wherein.

DESCRIPTION

Figure 1:
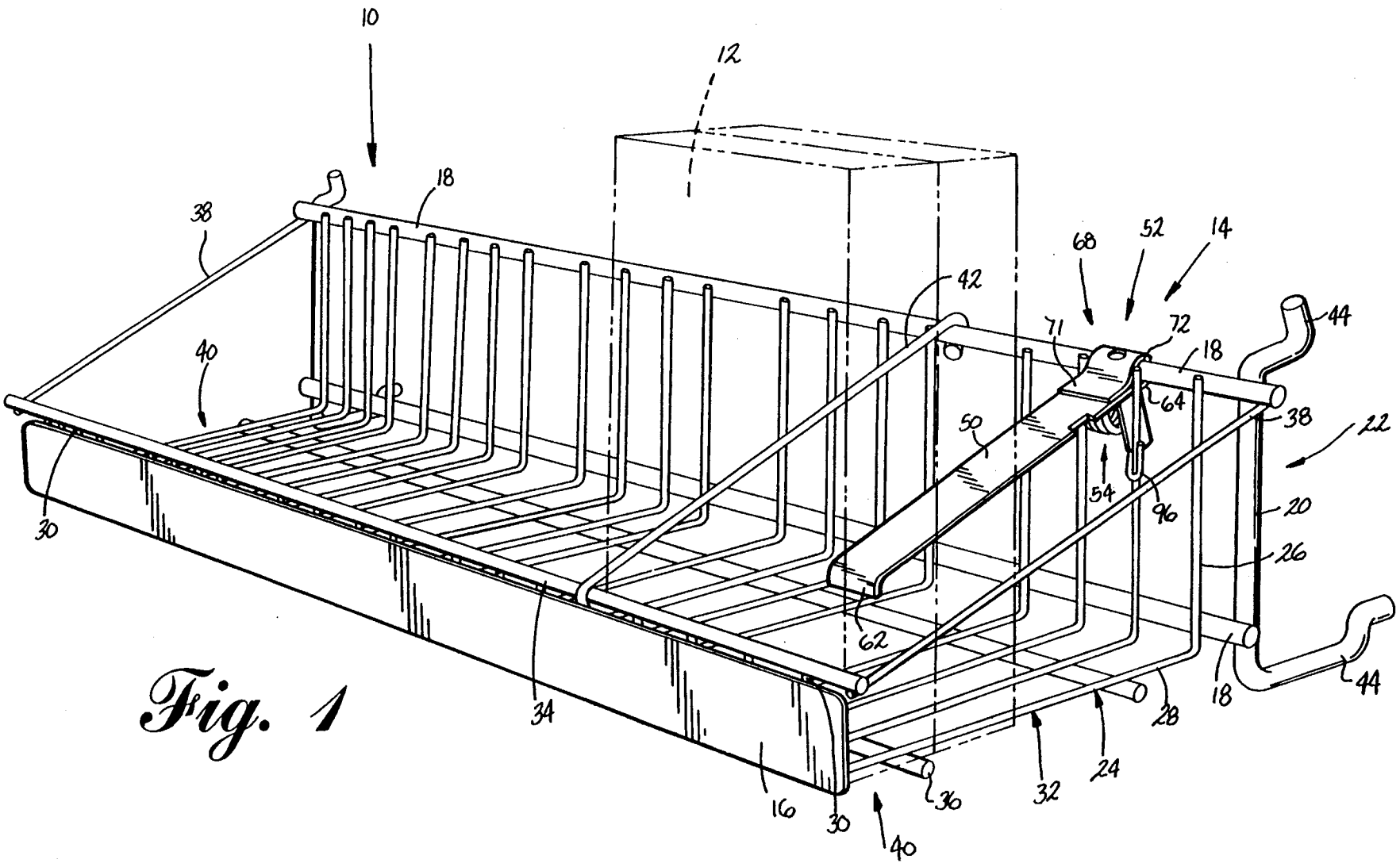
FIG. 1 is a perspective view of a shelf rack employing a facing device according to the invention.
Figure 2:
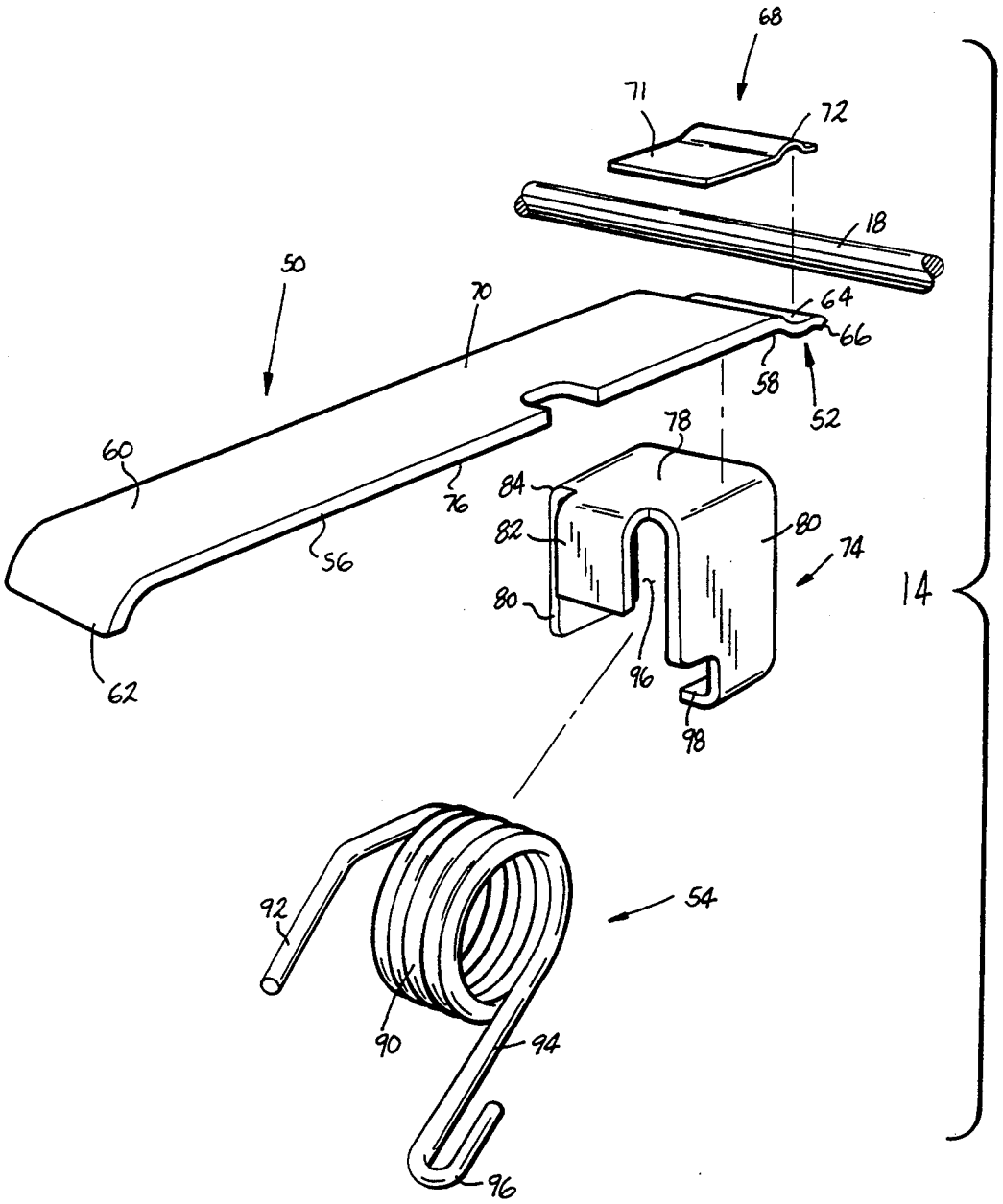
FIG. 2 is a perspective exploded view of the facing device of FIG. 1.

The principles of the invention as disclosed, by way of example, in the use of a shelf rack 10 and facing device 14 illustrated in FIGS. 1–4. Referring to FIG. 1 in particular, the wire shelf rack 10 is adapted for use in displaying products, such as pre-recorded videotapes 12. A facing device 14 according to the invention is provided for urging the videotapes 12 toward a front portion 16 of the shelf rack 10. The shelf rack 10 comprises a pair of parallel and spaced-apart rear horizontal wire bars 18 joined together by a pair of parallel and spaced-apart vertical wire bars 20 to form a rear portion 22 of the shelf rack 10. A plurality of J-shaped bars 24 have an elongated vertical rear portion 26 affixed to the rear horizontal bars 18, an elongated horizontal portion 28, and a short vertical front portion 30. The J-shaped bars 24 are spaced apart and oriented in parallel relation to each other, whereby the horizontal portions 28 thereof form a resting surface 32 upon which the videotapes 12 are placed.

A horizontal bar 34 extends across the front of the J-shaped bar front portions 30, and additional horizontal bars 36 are affixed to the underside of the J-shaped bar horizontal portions to provide rigidity to the shelf rack 10 due to its overall lattice structure. Side bars 38 extending between a top one of the rear horizontal bars 18 and the front horizontal bar 34 are provided at ends 40 of the shelf rack 10 to hold the videotapes 12 within the shelf rack 10. Movable spacer bars 42 may also be provided between the front and rear horizontal bars 34 and 18 to separate laterally adjacent videotapes 12 within the shelf rack 10. Projections 44 may be provided from the rear vertical bars 20 for installing the shelf rack 10 into a supporting device (not shown) in a conventional fashion.

The facing device 14 generally comprises a lever arm 50, a clip 52 on the lever arm 50 for rotatably mounting the lever arm 50 to the upper horizontal wire 18 in the shelf rack 10, and a coil spring 54 for biasing the lever arm 50 forwardly. The lever arm 50 comprises an elongated rectangular strip 56 having an inner end 58 and an outer end 60. The outer end 60 is curved downwardly to form a rounded surface 62 which pushes the rearmost videotape 12 forward in the shelf rack 10 as videotapes 12 are removed from the shelf rack front portion 16. The inner end 58 is bent to form a transverse semi-circular groove 64 adapted to engage the wire 18. A rearmost edge 66 of the strip 56 diverges slightly downwardly to accommodate insertion of the bar 18 between the lever arm 50 and the spring clip 52.

The clip 52 is formed of resilient material and has a generally rectangular shape. The clip 52 has a forward attachment surface 71 attached to an upper surface 70 of the strip 56 at its inner end 58. A rear transverse groove 72 is in opposing relation to the rear transverse groove 64 of the lever arm 50, whereby the rear horizontal bar 18 is securely held between the clip 52 and the lever arm 50, within the transverse grooves 64 and 72. Resiliency of the clip 52 and lever arm allows the facing device to be easily slipped onto or off of the rear horizontal bar 18, and the semi-circular transverse grooves 64 and 72 allow the lever arm 50 to rotate freely about the rear horizontal bar 18.

To hold the spring 54, a retaining bracket 74 attaches to an underside 76 of the strip 56. It is preferably bent from a single stamped piece of metal and comprises an upper panel 78 from which extend two spaced apart side panels 80 and a front panel 82. The front panel 82 is narrower than the distance between the side panels 80 thereby forming slots 84 therebetween. It is the upper panel 78 which affixes the retaining bracket 74 to the strip underside 76 at the rear end 58, preferably by welding.

A coil spring 54 comprises a coil 90 of spring wire having a first terminal end 92 and a second terminal end 94 extending tangentially therefrom. The coil 90 fits within a space 96 between the side and front panels 80 and 82 of the bracket 74 with the first terminal end 92 extending outwardly through the slot 84. To support the coil 90 from the rear, the retaining bracket 74 is positioned adjacent to the transverse groove 64 on the strip 56, whereby the transverse groove 64 is positioned immediately behind and abutting the coil 90.

Figure 3:
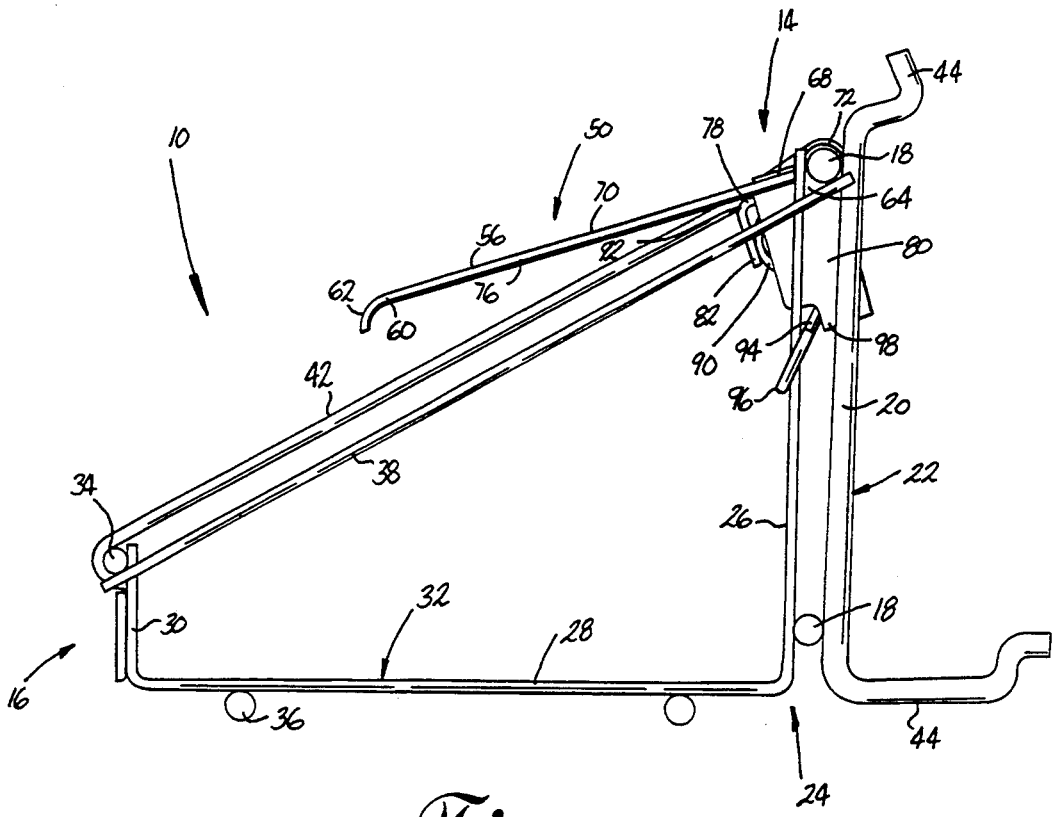
FIG. 3 is a side view of the shelf rack and facing device of FIG. 1.
Figure 4:
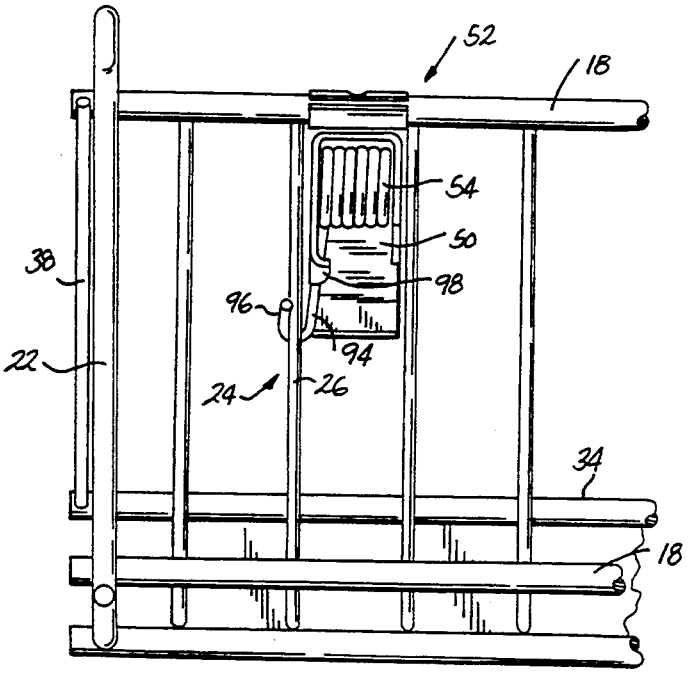
FIG. 4 is a rear view of a portion of the shelf rack and of the facing device of FIG. 1.

The first terminal end 92 of the coil spring 54 abuts the strip underside 76 and is preferably bent slightly toward the second terminal end 94 to facilitate centering under the lever arm 50. As also illustrated in FIGS. 3 and 4, the second lever arm 94 engages one of the J-shaped bar rear portions 26. Preferably, a U-shaped return lip 96 is formed in the second terminal end 94 for receiving the J-shaped bar 24. A stop 98 extends from the side panel 80 of bracket 74 toward the other side panel 80 and engages the second terminal end 92 of spring 54 to hold the spring 54 in a compressed condition and limit movement of the lever arm 50. The limit of spring-biased forward travel of the lever arm 50 is reached when the second terminal end 94 abuts the stop 98, as shown in FIG. 3.

The facing device 14 is particularly suited for retrofit to existing wire formed shelf racks, such as the shelf rack 10. The clip 52 allows the facing device 14 to be quickly attached to the rear horizontal bar 18 in the shelf rack 10 after which the return lip 96 of spring 54 need merely be placed to engage the vertical portion 26 of J-shaped bar 24 in the shelf rack 10. The facing device 14 is also easily removed in a reverse fashion so that it can be transferred to another shelf rack 10 or to an alternate position within the same shelf rack 10.

With the facing device 14 positioned within the shelf rack 10, videotapes 12 or other merchandise are inserted within the shelf rack 10 in an upright vertical position, with a descriptive portion of a label (not shown) thereof facing forwardly. As a front videotape 12 is removed, the action of the spring 54 urges the lever arm 50 forwardly which in turn urges the remaining tapes 12 toward the shelf rack forward portion 22. The videotapes 12 are thus presented in an orderly fashion, with their advertising labels prominently displayed at a forward-most portion of the shelf rack 10 to provide a pleasing and effective merchandise display.

Figure 5:
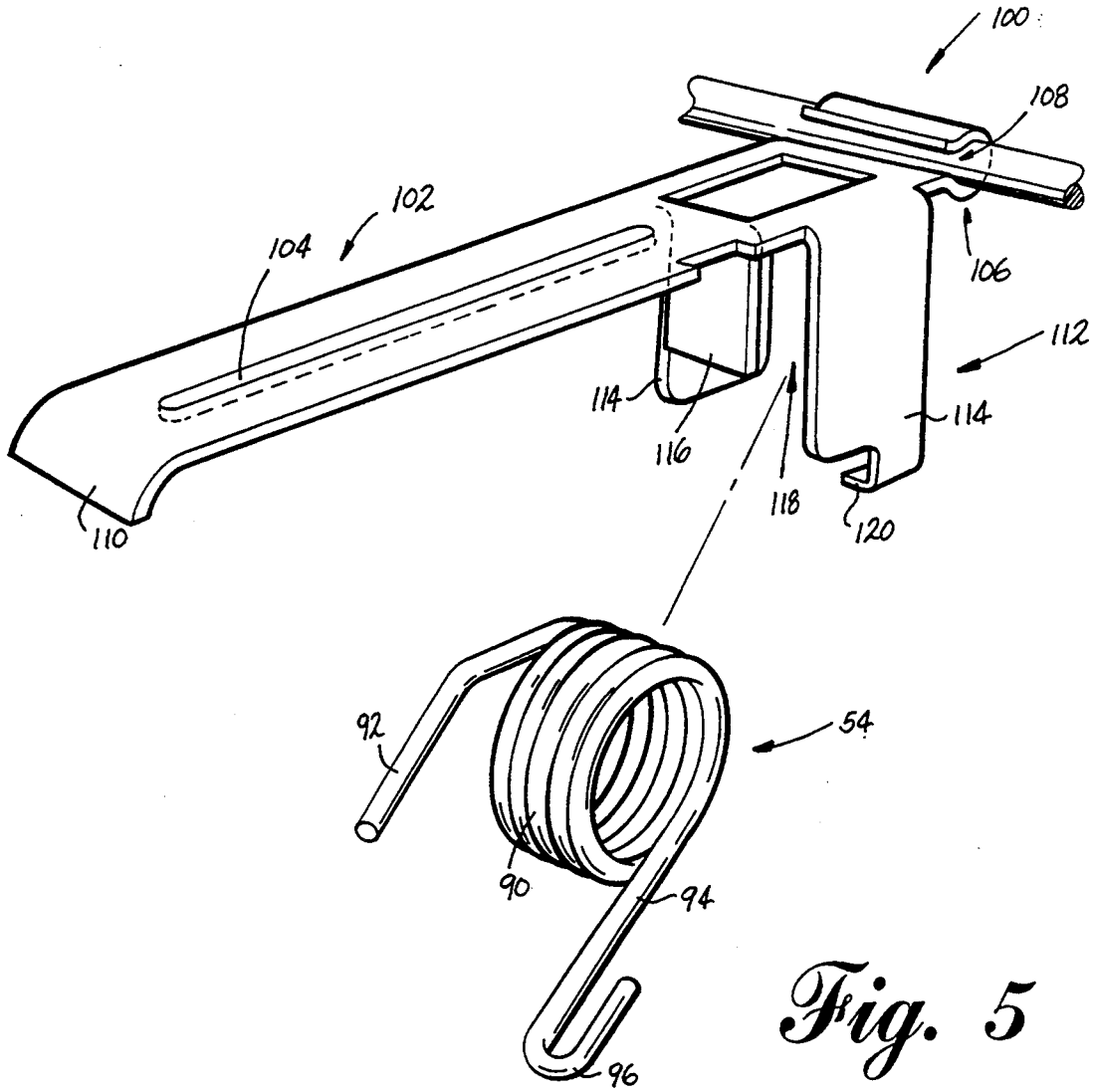
FIG. 5 is a perspective exploded view of an alternative embodiment of a facing device according to the invention.

An alternative embodiment of a facing device in accordance with the invention is shown in an exploded view of FIG. 5 as facing device 100. In contrast to the facing device 14 described with respect to FIGS. 1–4, the facing device 100 essentially comprises a "unitary" one-piece construction, with the exception of the coil spring 54. For purposes of description, and in view of the coil spring 54 illustrated in FIG. 5 having the substantially identical configuration as the coil spring 54 described with respect to FIG. 1–4, numerical references to portions of the coil spring 54 in FIG. 5 are identical to the references illustrated in FIGS. 1–4.

As shown in FIG. 5, the facing device 100 is adapted to be secured to a rear horizontal wire bar 18 extending horizontally along the rear portion of a shelf rack (not shown). As with the facing device 14 described with respect to FIGS. 1–4, the facing device 100 includes a lever arm 102. Extending longitudinally along an upper surface of the lever arm 102 is a reinforcing or "strengthening" rib 104.

Integrally associated with the lever arm 102 is a retaining portion 106 extending rearwardly and resiliently forming an aperture 108 into which the horizontal bar 18 can be inserted. With this interconnection of the facing device 100 to the horizontal bar 18, and with the retaining portion 106 appropriately sized and configured, the facing device 100 is rotatably coupled to the horizontal bar 18.

Extending forwardly from the lever arm 102 and integrally associated therewith is a rounded surface 110 which functions in an identical manner to the rounded surface 62 previously described with respect to FIGS. 1–4. That is, the rounded surface 110 will push against the rearmost videotape 12 (not shown in FIG. 5) so as to push the videotape forwardly within the shelf rack as videotapes are removed from the front portion of the shelf rack.

For purposes of appropriately holding the spring 54 within the facing device 14 illustrated in FIGS. 1–4, the facing device 14 incorporates a retaining bracket 74. In contrast, and as shown in FIG. 5, the essential structure and function of the retaining bracket 74 is provided by a retaining portion 112 integrally associated with the lever arm 102 and retaining portion 106. The retaining portion 112 includes two spaced-apart side panels 114 and a front panel 116. The front panel 116 is narrower than the distance between the side panels 114, thereby forming slots 118 therebetween. Again, the retaining portion 114 is formed as part of the facing device 100 by being integrally associated with the lever arm 102 and retaining portion 106.

As with the facing device 114 described with respect to FIGS. 1–4, the coil spring 54 comprises a coil 90 of spring wire having a first terminal end 92 and second terminal end 94 extending therefrom. The coil 90 fits within a space formed between the side panels 114 and front panel 116 of the retaining portion 112. The first terminal end 92 may extend outwardly through one of the slots 118. As provided within the facing device 14, the terminal end 94 of the coil 54 utilized with the facing device 100 is adapted to engage one of the J-shaped bar rear portions 26. A U-shaped return lip 96 is formed on the second terminal end 94 for receiving the J-shaped bar 24. A stop 120 extends from one of the side panels 112 and engages the second terminal end 92 to hold the spring 54 in a compressed condition and limit spring-biased movement of the lever arm 102. The limit of spring-biased forward travel of the lever arm 102 is reached when the second terminal end 94 abuts the stop 120. In this manner, the facing device 100 operates substantially identical in function with respect to the facing device 14. However, in contrast to the facing device 14, the facing device 100 includes fewer independent component parts, and all portions of the facing device 100 are integrally associated with each other, with the exception of the coil spring 54.

Figure 6:
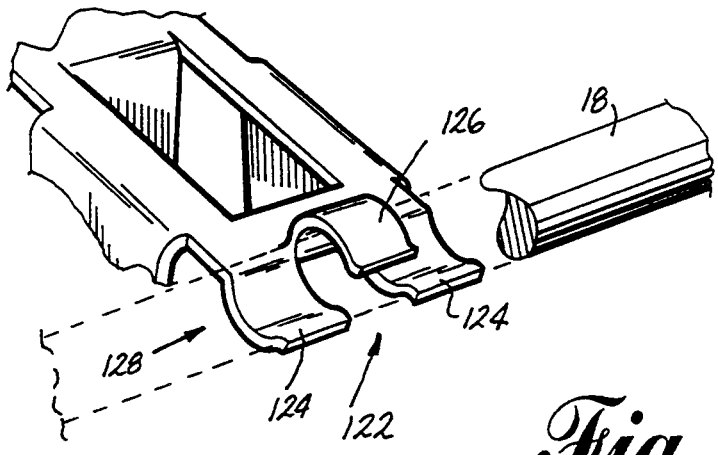
FIG. 6 is a perspective view of a portion of a further alternative embodiment of a facing device according to the invention, particularly showing an alternative arrangement for rotatably mounting the facing device to a horizontal wire.

As previously described with respect to FIG. 5, the facing device 100 includes a retaining portion 106 having the particular structural configuration shown in FIG. 5, for purposes of rotatably coupling the facing device 100 to a horizontal bar 18. Various configurations of the retaining portion 106 can be employed. For example, FIG. 6 illustrates a retaining portion 122 having a somewhat different configuration from the retaining portion 106 illustrated in FIG. 5. As shown in FIG. 6, the retaining portion 122 includes two upwardly curved portions 124 having rounded surfaces facing upwardly in a spaced apart configuration for purposes of securing the horizontal bar 18 to the retaining portion 122. A central downwardly curved portion 126 facing in an opposing manner is positioned intermediate the portions 124. The inner rounded surface of the downwardly curved portion 126 and the inner rounded surfaces of the upwardly curved portions 124 form an aperture 128 which is used to fasten the facing device to the horizontal bar 18 may be extended. The retaining portion 122 is composed of appropriate material and is of an appropriate size so as to provide a resiliency for purposes of rotably securing the facing device to the horizontal bar 18 into the aperture 128.

While particular embodiments of the invention have been shown, it will be understood, of course, that the invention is not limited thereto. Modifications may be made by those skilled in the art, particularly in light of the foregoing teachings. Reasonable variation and modification are possible within the scope of the foregoing disclosure without departing from the spirit of the invention. It is to be understood that the description of the particular embodiment contained herein is by way of illustration and not limitation, and that the scope of the appended claims should be construed as broadly as the prior art will permit.

What is claimed is:

1. A facing device for facing products displayed in wire shelf racks having a forward end and a rear end, the rear end comprising a horizontal wire and a vertical wire, and the facing device comprising:

a lever arm adapted to be rotatably coupled to the horizontal wire of the shelf rack;

a coil spring coupled to the lever arm and adapted to be coupled to the shelf rack for biasing the lever arm to rotate about the horizontal wire toward the shelf rack forward end, the coil spring comprising a coil of spring wire having first and second terminal ends extending tangentially from the coil, the first terminal end abutting the lever arm and the second terminal end adapted to be interconnected to the vertical wire upon assembly to the shelf rack; and a stop on the lever arm positioned to abut the second terminal end of the coil spring at a predetermined limit of forward travel of the lever arm, to limit the spread of the first and second terminal ends from each other and whereby to limit spring-biased forward travel of the lever arm.

2. A facing device according to claim 1 and further comprising retaining means attached to the lever arm and adapted to be rotatably coupled to the horizontal wire, for rotatably mounting the lever arm to the shelf rack.

3. A facing device according to claim 2 characterized in that said retaining means comprises a clip attached to the lever arm.

4. A facing device according to claim 2 characterized in that the retaining means is integrally associated with the lever arm.

5. A facing device according to claim 1 and further comprising a bracket means for holding the coil spring in abutment with the lever arm.

6. A facing device according to claim 5, wherein the bracket means comprises a bracket on the lever arm which receives the coil of spring wire.

7. A facing device according to claim 1 and further comprising a catch on the second terminal end, the catch being adapted to receive the vertical wire.

8. A facing device according to claim 7, wherein the catch comprises a portion of the second terminal end being folded over into a U-shaped configuration.

9. A facing device according to claim 3, wherein the lever arm comprises an elongated flat strip having an inner end and an outer end, the clip being located at the inner end and a rounded surface being provided at the outer end to provide a smooth pushing surface against products in the shelf rack.

10. A facing device according to claim 9, wherein the clip further comprises a semi-circular receiving surface for rotatively receiving the horizontal wire.

11. A facing device according to claim 1 and further comprising a bracket means for holding the spring in abutment with the lever arm, the bracket means comprising a bracket on the lever arm which receives the coil of spring wire and the stop being integral with the bracket.

12. A facing device according to claim 11, wherein the bracket comprises a forward wall, two side walls, and a stop extending inwardly from one side wall, the coil of spring wire being positioned therebetween.

13. A facing device for facing products displayed in wire shelf racks having a forward end and a rear end, the rear end comprising a horizontal wire and a vertical wire, and the facing device comprising:

a lever arm having a forward end and a rear end, with the forward end having a rounded surface;

a retaining clip integrally associated with the lever arm and formed at the rear end thereof, and adapted to be rotatably coupled to the horizontal wire, for rotatably mounting the lever arm to the shelf rack;

a coil spring coupled to the lever arm and adapted to be coupled to the shelf rack for biasing the lever arm to rotate about the horizontal wire toward the shelf rack forward end, the coil spring comprising a coil of spring wire having first and second terminal ends extending tangentially from the coil, the first terminal end abutting the lever arm and the second terminal end adapted to be interconnected to the vertical wire upon assembly to the shelf rack; and bracket means integrally associated with the lever arm and extending downwardly from the lever arm for receiving the coil of spring wire.

* * * * *